United States Patent [19]

Haft

[11] 4,159,108

[45] Jun. 26, 1979

[54] GARMENT STACKER

[76] Inventor: Peter Haft, 140 Kensington St., New York, N.Y. 11235

[21] Appl. No.: 858,492

[22] Filed: Dec. 8, 1977

[51] Int. Cl.[2] ..... B65H 29/34

[52] U.S. Cl. ..... 271/190; 271/199; 414/77

[58] Field of Search ..... 271/190, 189, 67, 73, 271/218, 199; 214/6 DK; 198/796

[56] References Cited

U.S. PATENT DOCUMENTS 3,598,252 8/1971 Billett et al. ..... 214/6 DK 3,768,807 10/1973 Spengler ..... 271/190

*Primary Examiner*—Bruce H. Stoner, Jr.

*Attorney, Agent, or Firm*—Leo C. Krazinski

[57] ABSTRACT

A garment stacking apparatus having a pair of belts travelling together at the same speed in which one belt provided with polyurethane on its surface feeds and urges a garment section on the second belt provided with a frictionless shutter and open space and, when the first belt is suddenly stopped while the second belt continues its movement, the garment section slides from the frictionless shutter onto the open space and drops into a receptacle.

7 Claims, 9 Drawing Figures

GARMENT STACKER

BACKGROUND OF THE INVENTION

The present invention relates to stacking apparatus and, more particularly to apparatus for placing in a pile a plurality of garment sections and the like.

DESCRIPTION OF PRIOR ART

As far as applicant is aware, stacking of garment sections is accomplished manually, requiring a conveyor belt for carrying the same, wherein an attendant places the garment sections seriatim at an input end of the belt and another attendant at the output end of the belt removes the garment sections and stacks them on a pile.

SUMMARY OF THE INVENTION

Accordingly, an object of the present invention is to provide an improved automatic apparatus for stacking garment sections and the like.

Another object of the invention is to substantially eliminate manual help in arranging in a pile a plurality of garment sections.

A further object of the invention is to accomplish the foregoing objects in a simple, practical and economical manner.

Other and further objects will be obvious upon an understanding of the illustrative embodiments about to be described, or will be indicated in the appended claims, and various advantages not referred to herein will occur to one skilled in the art upon employment of the invention in practice.

In accordance with the present invention, the foregoing objects are accomplished automatically in a manner similar to the well known fact that, if a glass of water is placed upon a sheet and the sheet quickly pulled, the glass of water will drop without spilling upon the table surface underneath. Thus, in this invention when a garment section is pushed into an entrance position of the stacker apparatus, it is detected by a photo-electric sensor, which energizes movement of a belt having a high friction surface for feeding the garment section onto a conveyor belt that is being constantly driven. The conveyor belt has two spaced shutter sections of low friction surface with the two areas between the shutters being open gaps, so that as the shutter reaches the entrance position a start limit switch is energized. Both belts are synchronized in speed and bring the garment section to a midway position whereupon a stop limit switch is actuated to stop the feed belt. Since the conveyor belt is continuously driven and since the shutters are frictionless, the garment section is moved to the open gap area and drops into the receptacle.

BRIEF DESCRIPTION OF THE DRAWING

A preferred embodiment of the invention has been chosen for purposes of illustration and description and is shown in the accompanying drawings, forming a part of the specification, wherein:

FIG. 8 is a circuit design of the invention.

FIG. 9 is a side elevational view of another embodiment of the invention showing only one shutter on the conveyor belt and rear stacking of the garment sections as against side stacking in the first embodiment.

Figure 1:
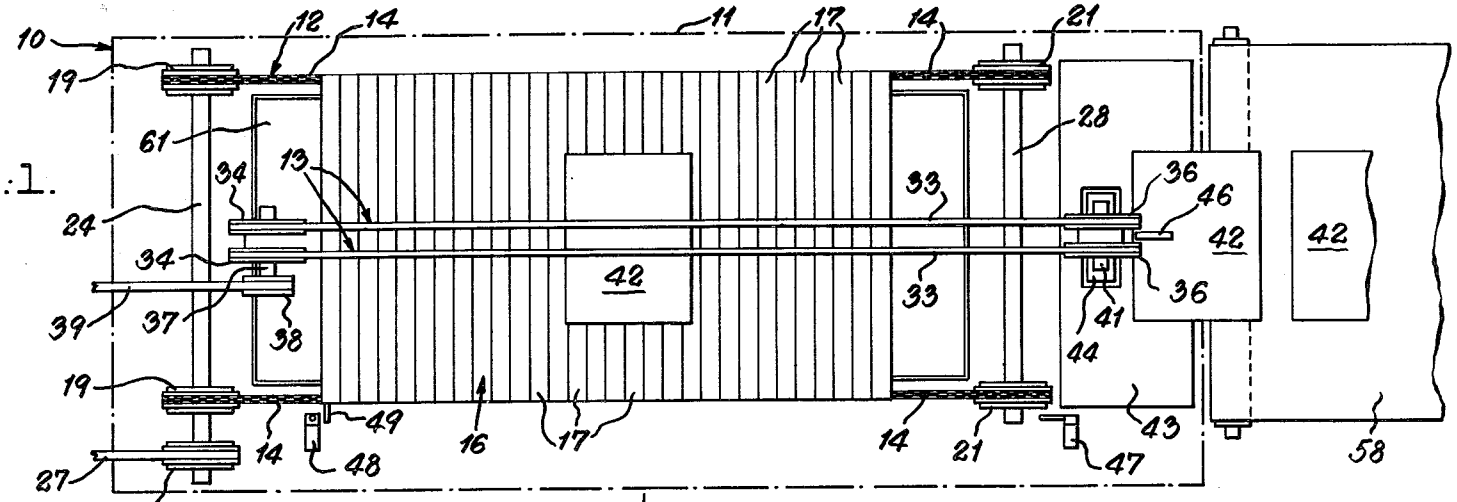
FIG. 1 is a plan view of the garment stacker.

Referring now to the drawings in detail, particularly to FIGS. 1–4, there is shown a garment stacker 10 including a frame 11 for containing component parts of the stacker 10. These parts are shown as essentially a conveyor belt 12 and a feed belt 13. The conveyor 12 comprises two spaced chain links 14 having transversely secured thereto a pair of spaced shutters 16, each shutter 16 having a plurality of preferably stainless steel plates 17 (FIGS. 3 and 4) secured to the chain links 14 by rivets 18. The surfaces of the shutter steel plates 17 are so smooth as to be practically frictionless for the purpose of use, as will be brought out hereinafter. Both chain links 14 of the conveyor belt 12 revolve on upper sprockets 19 and 21 and lower sprockets 22 and 23, upper sprockets 19 being rigidly secured to a driving shaft 24 that is rigidly secured to a driving sprocket 26, which in turn is connected to a drive belt 27 driven by a motor (not shown). Sprockets 21, 22 and 23 may be loosely mounted on shafts 28, 29 and 31, respectively. The conveyor belt 12 with its two spaced shutters 16 revolves around the sprockets continuously and it is to be noted that between the shutters linearly there are two open spaces or gaps 32 for a purpose that will appear hereinafter.

The feed belt 13 comprises a pair of belts 33 mounted on driving pulleys 34 and idler pulleys 36 with the pulleys 34 rigidly secured to a driving stub shaft 37 which is also rigidly secured to a driving pulley 38, in turn connected by a belt 39 to a driving source (not shown). The idler pulleys 36 may be loosely mounted on a stub shaft 41. The outer peripheral surfaces are of high frictional resistance by application thereto of a substance, such as polyurethane, and the feed belt 13 with its pulleys are an disposed that the peripheral surfaces of the belts 33 are substantially in contact with the shutters 16 of the conveyor belt 12, as is evident in FIG. 2, whereby a garment section 42 may be conveyed therebetween.

Figure 2:
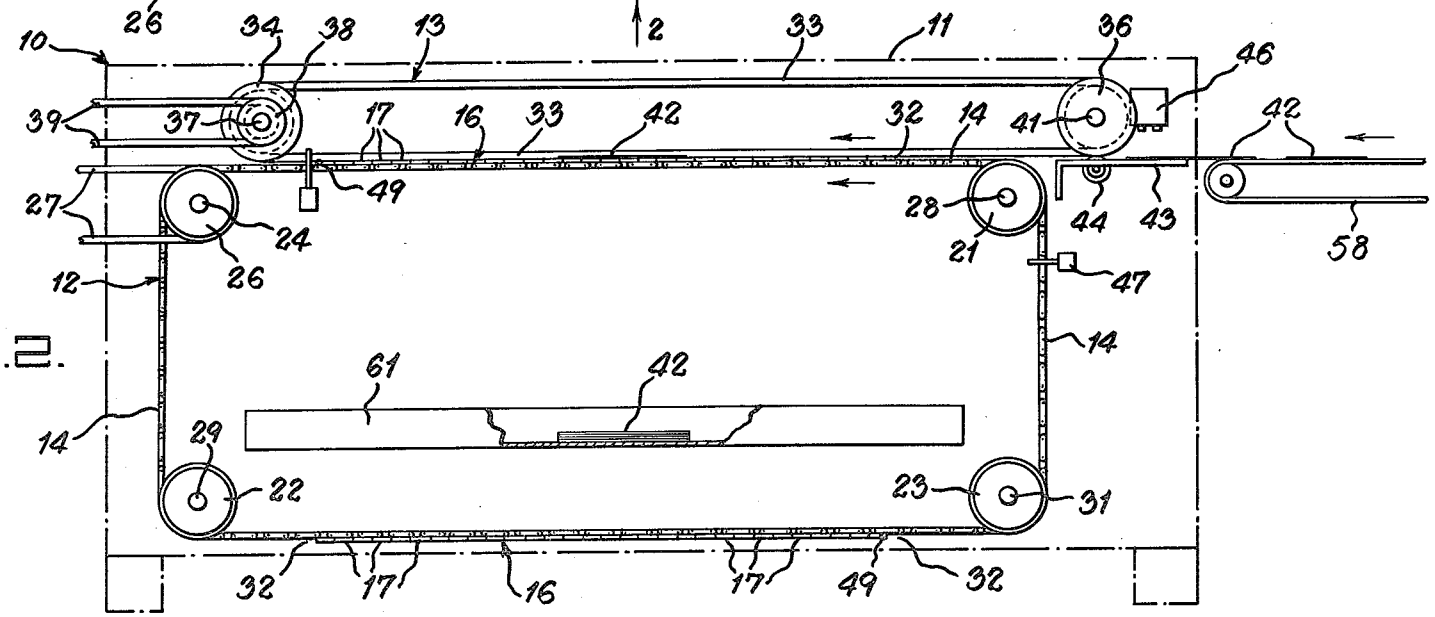
FIG. 2 is a side elevational view taken in the direction of the arrow 2 in FIG. 1.

At the input or right side of the frame 11, as seen in FIGS. 1 and 2, is shown a shelf 43 carrying small idler wheels 44 in contact with pulleys 36 for providing a nip to seize the garment section 42 when brought to it and a photo-electric sensor 46 for detecting presence of the garment section 42. Also adjacent the right side of the frame 11 is shown a start limit switch 47 which is actuated by the shutter 16 of the conveyor belt and at the left side of the frame 11 there is shown a stop limit switch 48, also actuated by the shutter 16, as it passes by. Each of the shutters 16 is provided at its leading edge with a pin 49 for contacting the switches 47 and 48.

Referring now to FIG. 8, there is shown a circuit design of the garment stacker, wherein the sensor 46, which is a retro-reflective photo-electric detector, senses approach of the garment section 42. The signal from the sensor 46 is amplified by amplifier 51 and fed into logic module 52, which compares the time of arrival of the signals from the sensor 46 and the start limit switch 47, when actuated by the shutter pin 49. When these two signals occur in proper sequence, the logic module 52 actuates an output relay 53 that deenergizes an electro-magnetic brake 54 and energizes an electromagnetic clutch 56 which drives the feed belt 13 in order to load an incoming garment section 42 onto one of the shutters 16. A power supply 57 of suitable capacity supplies the necesssary electrical energy to the electrical components 51–53.

Figure 7:
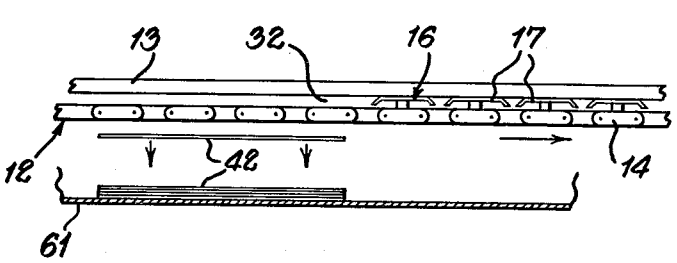
FIG. 7 is similar to FIG. 6 but showing garment section fully released from shutter and dropping to receptacle.
Figure 6:
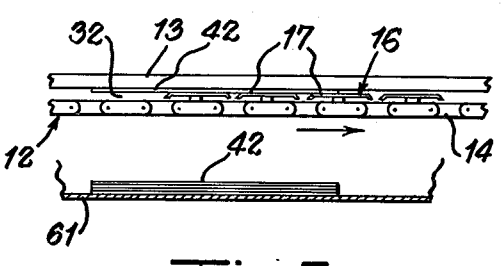
FIG. 6 is similar to FIG. 5 but showing the conveyor belt with shutter in motion and the feed belt stationary and left portion of garment section in gap area.
Figure 5:
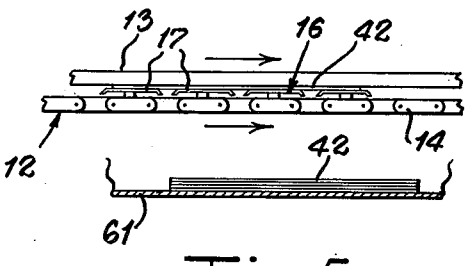
FIG. 5 is a partial side elevational view of both belts in motion with the garment section therebetween.
Figure 3:
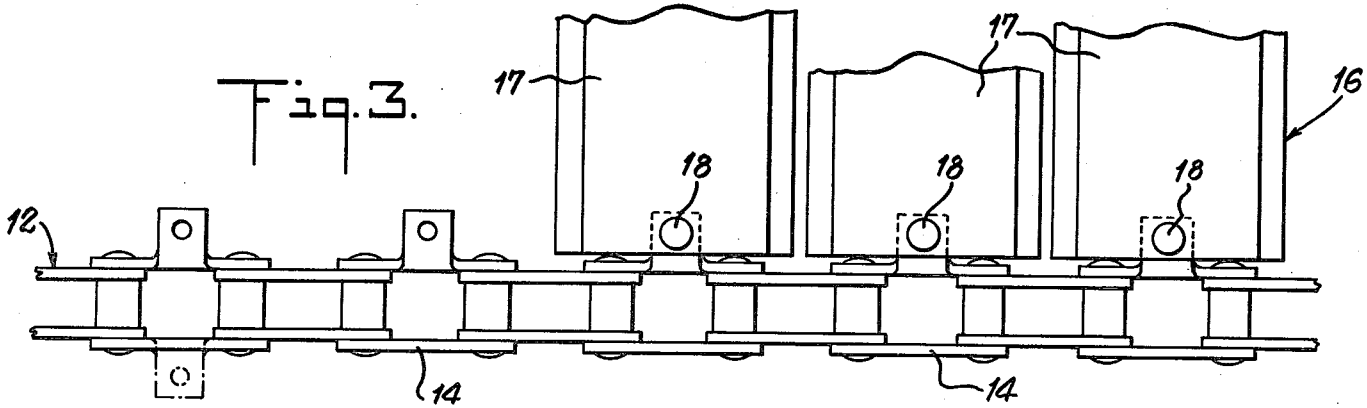
FIG. 3 is a partial top plan view showing the chain and shutter construction of the conveyor belt.
Figure 4:
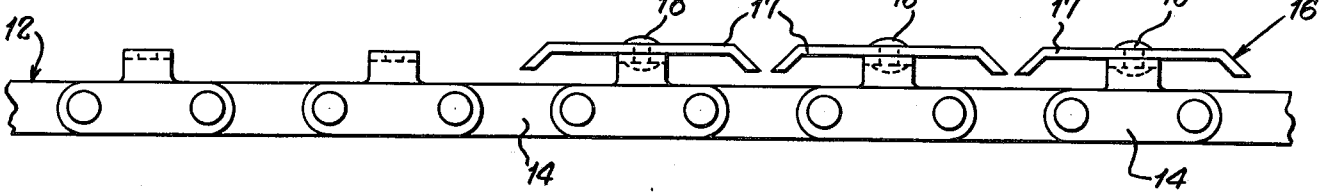
FIG. 4 is a side elevational view of the chain and shutter shown in FIG. 3.
Figure 3:
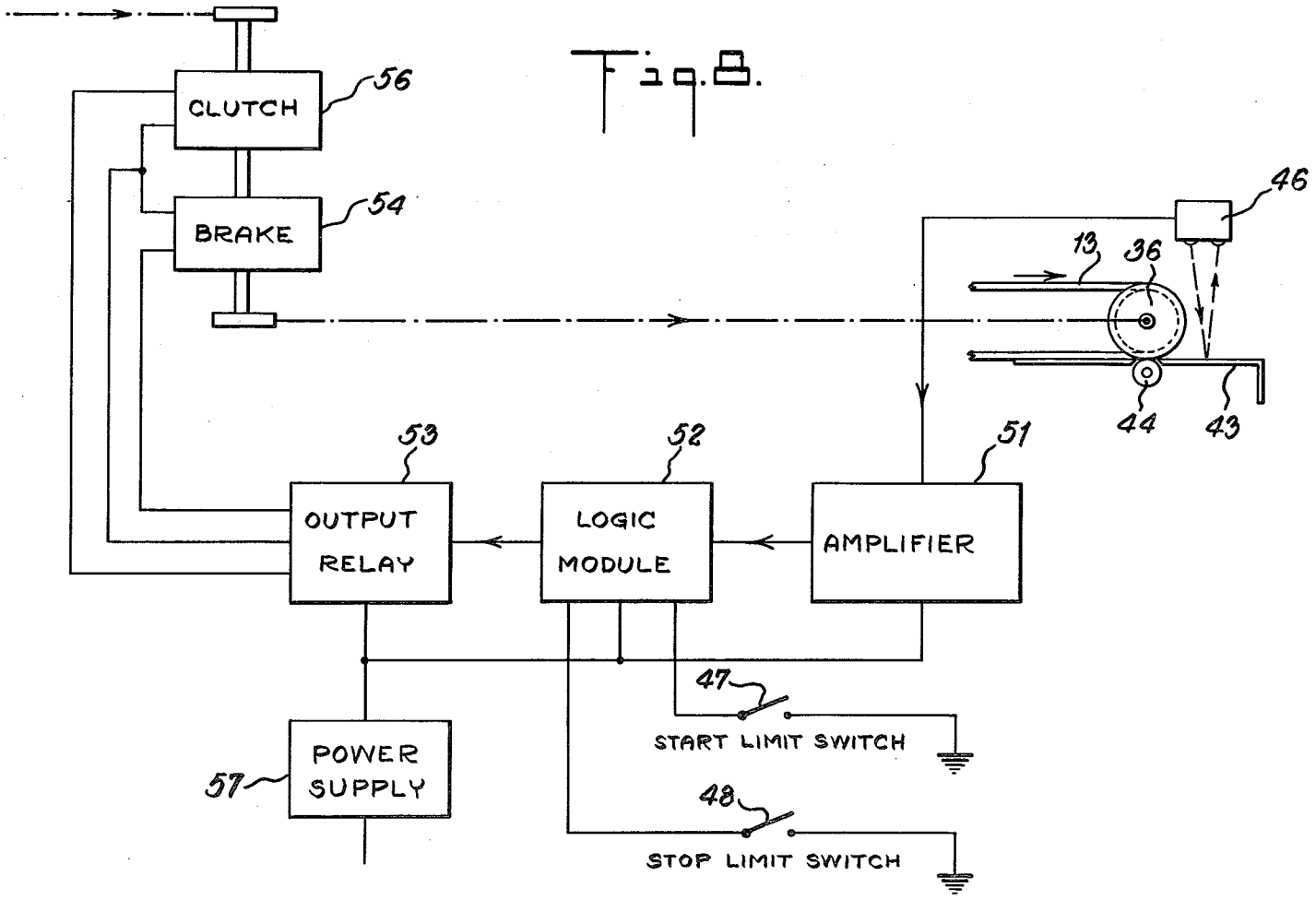
Figure 5:
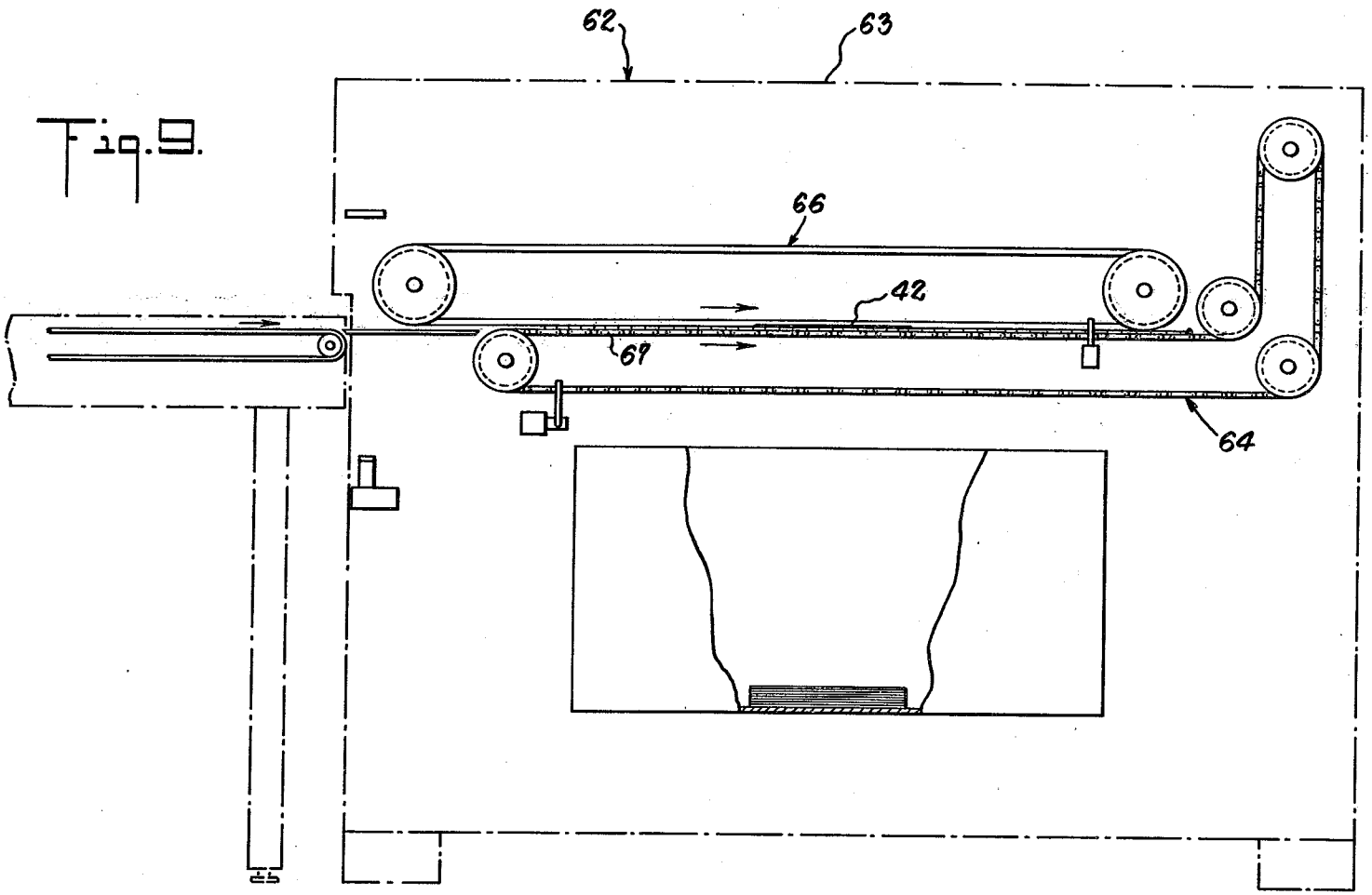

For a better understanding of the invention the operation thereof will now be described. Let it first be assumed that the various components have been energized, so that the conveyor belt 12 is being driven constantly in the direction of the arrow, the feed belt 13 is being held in a stationary condition by the brake 54 and a garment section 42 is being brought to the stacker 10 (right side of FIGS. 1 and 2) by a belt 58. As soon as the garment section 42 is detected by the sensor 46, a signal is transmitted to the logic module 52 which awaits a signal from the start limit switch 47. Accordingly, when the pin 49 of one of the shutters 16 of the conveyor belt 12 engages the start limit switch 47, the corresponding signal is transmitted to logic module 52 which then energizes the output relay 53. Operation of relay 53 causes the brake 54 to disengage and the clutch 56 to produce rotation of the feed belt 13 in the direction of the arrow and rotation of pulleys 44 and 36 for seizing the garment section 42 at their nip. Both belts 12 and 13 are now moving at the same speed and the garment section 42 is deposited by virtue of seizure by pulleys 36 and 44 on the shutter 16 and carried by both belts, as seen in FIGS. 1, 2 and 5. As soon as the pin 49 strikes the stop limit switch 48, a signal is passed from the latter to the logic module 52 which causes output relay 53 to disengage clutch 56 and engage brake 54. The feed belt 13 and associated pulleys immediately stop while the conveyor belt 12 continues on its movement, so that the friction of feed belt 13 prevents forward movement of the garment section 42 on the substantially frictionless shutter plates 17. As seen in FIG. 6, a trailing portion of the garment section 42 is shown over the gap 32 in the conveyor belt 12 and in FIG. 7 the entire portion of garment section 42 is over the gap 32 and, falling downwardly is stacked in a receptacle 61. Additional garment sections 42 are processed and stacked in the receptacle 61 in a similar manner.

Referring now to FIG. 9 there is shown a garment stacker 62 having a frame 63 containing a conveyor belt 64 and feed belt 66 for stacking garment sections 42 at the rear of the frame 63 instead of at the side of the frame 11 in the first embodiment. In this second embodiment the conveyor belt 64 has only one shutter for carrying the garment sections 42 and the component parts are arranged accordingly. The operation in this embodiment is substantially similar to that already covered in the first embodiment and repetition thereof is not deemed necessary.

From the foregoing description, it will be seen that the present invention provides a novel garment stacking apparatus that is substantially automatic, thereby minimizing the use of manual help with consequent economy in stacking garment sections.

As various changes may be made in the form, construction and arrangement of the parts herein, without departing from the spirit and scope of the invention and without sacrificing any of its advantages, it is to be understood that all matters are to be interpreted as illustrative and not in any limiting sense.

What is claimed is:

1. A garment stacking apparatus for piling garment sections in a receptacle comprising, in combination, a frame, a conveyor belt revolvable in said frame, a shutter on said conveyor belt having a substantially frictionless surface, said conveyor belt having an open space adjacent each end of said shutter, a feed belt having a substantially frictional outer surface revolvable in said frame, means for revolving said belts in the same direction at a synchronous speed, said shutter being in light contact with said frictional outer surface of said feed belt during movement, means for placing a garment section between said belts and upon said shutter, and electromagnetic control means for stopping said feed belt while said conveyor belt continues movement, whereby said garment section is held stationary by said feed belt and slid off of said shutter unto said open space and dropped into the receptacle, said electromagnetic control means including braking means for initially keeping said feed belt stationary, sensing means for detecting approach of a garment section at a nip between said belts, switch means responsive to engagement by said shutter, electronic means responsive to said sensing and switch means for releasing said braking means to enable said feed belt to revolve and at the nip draw said garment section between said belts, whereby said garment section is carried upon said shutter, and second switch means engaged by said shutter after the shutter has travelled a predetermined distance, said electronic means being responsive to said second switching means to reenergize said braking means and in turn stop said feed belt.

2. A garment stacking apparatus in accordance with claim 1, wherein said braking means include an electromagnetic clutch and electromagnetic brake.

3. A garment stacking apparatus in accordance with claim 2, wherein said electronic means include a logic module and relay.

4. A garment stacking apparatus in accordance with claim 3, wherein said garment section placing means include a moving belt that brings the garment section to the nip between the feed and conveyor belts.

5. A garment stacking apparatus in accordance with claim 4, wherein said shutter includes stainless steel plates.

6. A garment stacking apparatus in accordance with claim 5, wherein said feed belt has its outer peripheral surface covered with polyurethane.

7. A garment stacking apparatus in accordance with claim 6, wherein said conveyor belt includes a pair of spaced shutters.

* * * * *